US005673870A

United States Patent [19]

Fielding et al.

[11] Patent Number: 5,673,870

[45] Date of Patent: Oct. 7, 1997

[54] METHOD AND APPARATUS FOR REELING A TRAVELING PAPER WEB

[75] Inventors: Andrew Fielding, Wigan; Andrew D. White, Bolton, both of England

[73] Assignee: Beloit Technologies, Inc., Wilmington, Del.

[21] Appl. No.: 574,824

[22] Filed: Dec. 19, 1995

[51] Int. Cl.[6] ..... B65H 18/14; B65H 18/26; B65H 19/28; B65H 19/22

[52] U.S. Cl. ..... 242/542.3; 242/532.2; 242/533.2; 242/534.2; 242/541.1; 242/541.7

[58] Field of Search ..... 242/542.3, 541.1, 242/541.7, 532.2, 533.2, 534.2

[56] References Cited

U.S. PATENT DOCUMENTS

| | | | |
|---|---|---|---|
| 1,951,715 | 3/1934 | Valentine et al. | 242/542 |
| 3,116,031 | 12/1963 | Moore et al. | 242/65 |
| 3,743,199 | 7/1973 | Karr et al. | 242/65 |
| 3,857,524 | 12/1974 | Melead et al. | 242/56 R |
| 3,889,892 | 6/1975 | Melead | 242/56 R |
| 4,179,330 | 12/1979 | Page | 242/65 X |
| 4,905,925 | 3/1990 | Kremar | 242/65 |
| 4,934,619 | 6/1990 | Snygg | 242/56 R |
| 4,979,689 | 12/1990 | Snygg | 242/65 |
| 5,026,005 | 6/1991 | Ehrola | 242/65 |
| 5,106,029 | 4/1992 | Ehrola | 242/65 |
| 5,184,787 | 2/1993 | Holzinger et al. | 242/65 |
| 5,240,198 | 8/1993 | Dörfel | 242/65 |
| 5,249,758 | 10/1993 | Müller et al. | 242/65 |

(List continued on next page.)

FOREIGN PATENT DOCUMENTS

| | | |
|---|---|---|
| 395 893 B1 | 4/1990 | European Pat. Off. . |
| 483 092 | 10/1991 | European Pat. Off. . |
| 483 093 | 10/1991 | European Pat. Off. . |
| 1 560 039 | 8/1964 | Germany . |
| 1 574632 | 1/1969 | Germany . |
| 4007 329 | 3/1990 | Germany . |
| 4401804 | 1/1994 | Germany . |
| 379585 | 9/1932 | United Kingdom . |
| 2 012 733 | 1/1979 | United Kingdom . |
| 90 00511 | 1/1990 | WIPO . |
| 93 06033 | 4/1993 | WIPO . |
| 93 06034 | 4/1993 | WIPO . |
| 93 24401 | 12/1993 | WIPO . |
| 94 26641 | 11/1994 | WIPO . |

OTHER PUBLICATIONS

"The New Optireel for Better Paper Reeling" by J. Tulokas & M. Kyytsönen; 79th Annual Mtg. Technical Sect., CPPA, pp. A255,A259.

"Improved Reel Structure with Optireel Reduces Amounts of Broke and Gives Better Roll Quality" by S. Renvall, Valmet (undated).

*Primary Examiner*—John Q. Nguyen

*Attorney, Agent, or Firm*—Dirk J. Veneman; Raymond W. Campbell; Gerald A. Mathews

[57] ABSTRACT

A reel apparatus for reeling a traveling web produced on a papermaking machine comprises a rotatable support drum which is fixedly mounted in a frame. A pair of parallel, horizontally disposed rails are mounted to the frame with the tops of the rails above the apex of the support drum. New reel spools are brought into supporting engagement on the rails at a location downstream of the apex of the support drum and intermediate the apex of the support drum and a jumbo-sized wound web roll which is being wound while being powered by a centerwind assist drive, as well as nipping engagement with the support drum. Each reel spool is supported in a pair of carriages which are mounted to travel over the rails. Hydraulic cylinders selectively move each pair of carriages reciprocally along the rails between a new-reel- spool-receiving, or ready, position, a reeling position where the reel spool/newly-started- wound-web roll is nipped against the support drum, a downstream position where the wound paper web roll is disengaged from its nip with the support drum, and an ejection position where the wound web roll is moved against stops at the far end of the rails away from the support drum.

11 Claims, 9 Drawing Sheets

U.S. PATENT DOCUMENTS 5,251,835 10/1993 Kyytsönen ..... 242/65
5,360,179 11/1994 Vesteriren et al. ..... 242/532.2
5,370,327 12/1994 Adamski ..... 242/533.1
5,375,790 12/1994 Svanqvist ..... 242/541.1
5,393,008 2/1995 Kyytsonen et al. ..... 242/542.3
5,544,841 8/1996 Didier et al. ..... 242/542.3
5,560,566 10/1996 Bagnato ..... 242/542.3

METHOD AND APPARATUS FOR REELING A TRAVELING PAPER WEB

BACKGROUND OF THE INVENTION

1. Field of the Invention

This invention relates to the reeling of a traveling web of paper, such as that which is continuously being produced by a papermaking machine, continuously onto successive reel spools to produce a corresponding succession of relatively large diameter wound paper web rolls so as, for example, to accommodate the continuous production of a papermaking machine. More specifically, this invention relates to a method and apparatus for effecting the continuous production of a wound paper web roll continuously without transferring the wound web roll from one nip actuating apparatus to another. Still more particularly, this invention relates to a reeling method and apparatus which utilizes a fixedly mounted rotatable support drum and in which new reel spools are positioned on parallel, horizontally extending rails above the apex of the support drum, and downstream thereof, and remain downstream of the apex of the support drum during the entire reeling process.

2. Description of the Prior Art

Until recently, reels for reeling paper manufactured by papermaking machines were of the so-called Pope-type wherein a new reel spool was secured into a pair of primary arms which brought the reel spool into nipping engagement with a support drum at a location on the upper portion of the support drum surface. As the paper web roll began being wound onto the reel spool, the primary arms rotated downwardly over a segment of the support drum surface to deposit the reel spool onto a pair of parallel, horizontally disposed rails which had an elevation approximately coincident with the axis of revolution of the support drum. At that point, the newly started paper web roll was transferred to a pair of secondary arms which urged the paper web roll being wound against the support drum while being supported on the horizontal rails.

The transfer of the newly started paper web roll from the primary arms to the secondary arms could not be effected without a dramatic fluctuation in the nip load of the newly started web roll against the support drum. Such a differential in the nip load causes defects and damage to the paper as the web roll being wound increases in diameter. An example of such a Pope-type reel is shown and described in U.S. Pat. No. 3,743,199 (Karr et al).

A dramatic improvement in reel design was recently patented in U.S. Pat. No. 5,370,327 (Adamski), the disclosure of which is hereby incorporated by reference. In this reel design, a supply of reel spools is stored on a pair of parallel, horizontal rails and successive ones of the stored reel spools are brought into nipping engagement with a rotatable support drum which is mounted beneath the rails for translational movement such that its surface engages a new reel spool along a nip line of contact therewith upstream of the apex of the support drum surface. The support drum moves translationally downwardly while maintaining nipping contact with the newly started reel spool as the reel spool passes over the support drum apex to the downstream side of the support drum while maintaining continuous supporting contact on the rails. On the downstream side of the support drum, actuators maintain contact of the web roll being wound against the support drum continuously until the web roll reaches its desired diameter.

Such a winder works very well, but it has been found that for very lightweight grades of paper, such as tissue, it is difficult to incrementally move the support drum translationally for very small distances, due to the weight of the support drum, to maintain the very light nip pressures required to reel tissue without unduly compacting the tissue paper. A similar problem occurs during the reeling of so-called carbonless copy paper which has a coating which is extremely sensitive to any impressions made on the paper during the reeling process.

SUMMARY OF THE INVENTION

The problems associated with the reeling of tissue paper rolls, particularly jumbo tissue paper rolls, have been obviated by this invention. In the paper industry, a so-called jumbo roll is a wound paper web roll which has a diameter of about 2 m, or larger. Of course, this jumbo designation might vary somewhat, depending on the grade of paper being reeled into the wound web roll.

By fixedly mounting the rotatably driven support drum, there is no need to try to move the heavy support drum translationally in incremental distances in order to provide the extremely small nip pressure loadings required to reel the jumbo roll with the proper amount of internal web tension which is partially provided by the nip line of contact between the wound web roll and the support drum. In addition to controlling the nip pressure at a very low level (i.e. about 1 pound per lineal inch or about 0.178 Kg/cm), the reel spool on which the paper web is wound is driven from the time of turn-up (i.e. when the web is initially wrapped onto the new reel spool) until the time the completed jumbo roll is finished being wound.

The concept of the invention is advantageously embodied by combining the fixedly mounted support drum with a pair of parallel, spaced, horizontally extending rails which are positioned above the apex of the surface of the support drum. A supply of empty, or new, reel spools is provided at a location near and above the support drum. A pair of linked arms are pivotally disposed to receive a new reel spool and pivotally move it downwardly to be set upon and supported by the rails at a ready location downstream from the apex of the support drum and not in contact with either the support drum or any web roll being wound at the time.

The positioning of the new reel spool along the rails is provided by a pair of carriages, one carriage associated with each rail, with each carriage in the pair powered to move in controlled association with the other of the paired carriages to rotatably support either end of the reel spool and to move the reel spool translationally along the rails.

The new reel spool is first engaged by a so-called centerwind assist drive to bring it up to speed, and is then moved along the rails upstream to be in a turn-up position where the reel spool is in nipping engagement with the support drum to begin the reeling process by being wrapped with an on-coming paper web.

As the web is reeled onto the new reel spool, the carriages rotatably supporting the reel spool are moved downstream along the rails while the web roll being wound is maintained in nipping contact with the support drum. Eventually, as the wound web roll reaches jumbo size, that is about 2 m or larger, the space on the rails between the surface of the web roll being wound and the apex of the support drum is such that a new reel spool can be rotatably mounted in a second pair of carriages in this space with a gap between the adjacent surfaces of the new reel spool, the web roll being wound and the support drum. These gaps allow the new reel spool to be engaged by a centerwind assist drive to bring it up to speed before it is brought into nipping engagement with the support drum.

Since both the paper web roll being wound into a jumbo roll, as well as the new reel spool on which the on-coming paper web is to be wound, are both disposed downstream of the apex of the support drum, and since they are not in contact with one another when they are both in nipping contact with the support drum, control of the jumbo roll and the new reel spool can be simultaneously maintained by both centerwind drive assist and nipping engagement with the support drum.

The pair of carriages supporting both the jumbo roll and the newly started reel spool are independently controlled to provide the desired positioning relative to, and nipping engagement with, the support drum while support of the weight of both the jumbo roll, the newly started reel spool and the support drum are separately provided independently by the rails, for the jumbo roll and new reel spool being started, and by the frame of the reel apparatus, for the support drum.

This invention provides control of the reeling speed and nip at all times from the beginning of the reeling process onto a new reel spool until the jumbo roll is completely wound. In particular, this invention provides for the application and control of light nip loads useful in the reeling of lightweight grades of paper and pressure sensitive paper. In addition, there is no transfer of the paper web roll being wound from one nip actuating apparatus to another. Once the new reel spool is deposited by the pivoting arms into a pair of carriages, where it is rotatably supported, it remains in those carriages at all times until the completed jumbo roll is removed from the far downstream ends of the rails about which the carriages are mounted.

Accordingly, an advantage of this invention is the provision of a method and apparatus for reeling a jumbo-sized paper web roll.

Another advantage of this invention is the provision of a method and apparatus for reeling a tissue paper web wherein the nip pressure applied to the web roll being wound can be applied and controlled at a low level.

Another advantage of this invention is that there is no transfer of the web roll being wound from one nip actuating apparatus to another during the entire reeling procedure.

Still another advantage of this invention is that control of both the speed of the web roll being wound, and its nipping engagement with the support drum, is maintained at all times during the reeling procedure.

Other advantages of this invention will become readily apparent to those skilled in the art when reading the description of the preferred embodiment in conjunction with the attached figures.

DESCRIPTION OF THE PREFERRED EMBODIMENTS

Figure 1:
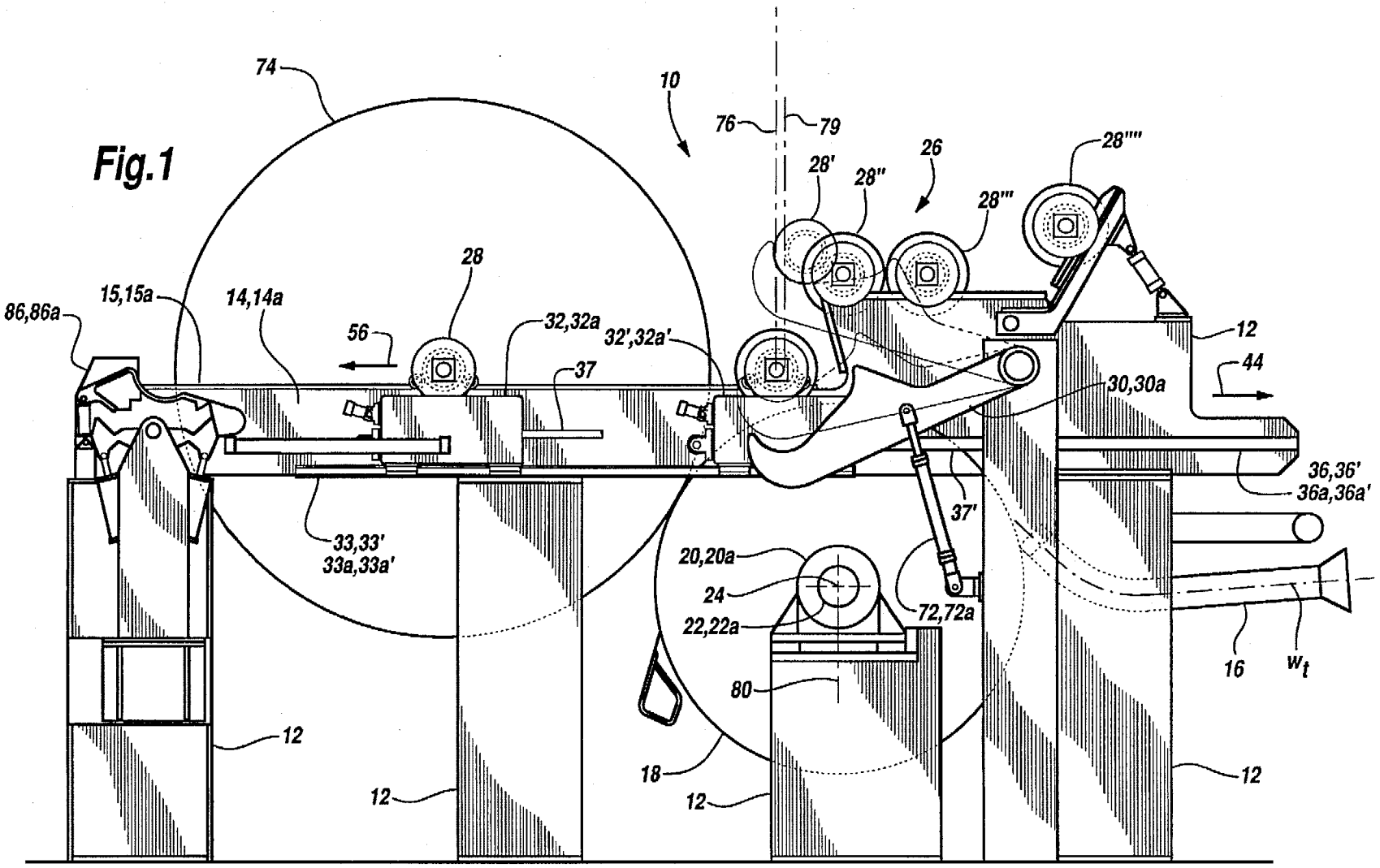
FIG. 1 is a side-elevational view of the reel apparatus showing the initial step in the operation of the apparatus of removing a new reel spool from a storage position and moving the new reel spool to its initial position supported on a pair of horizontally disposed rails.
Figure 2:
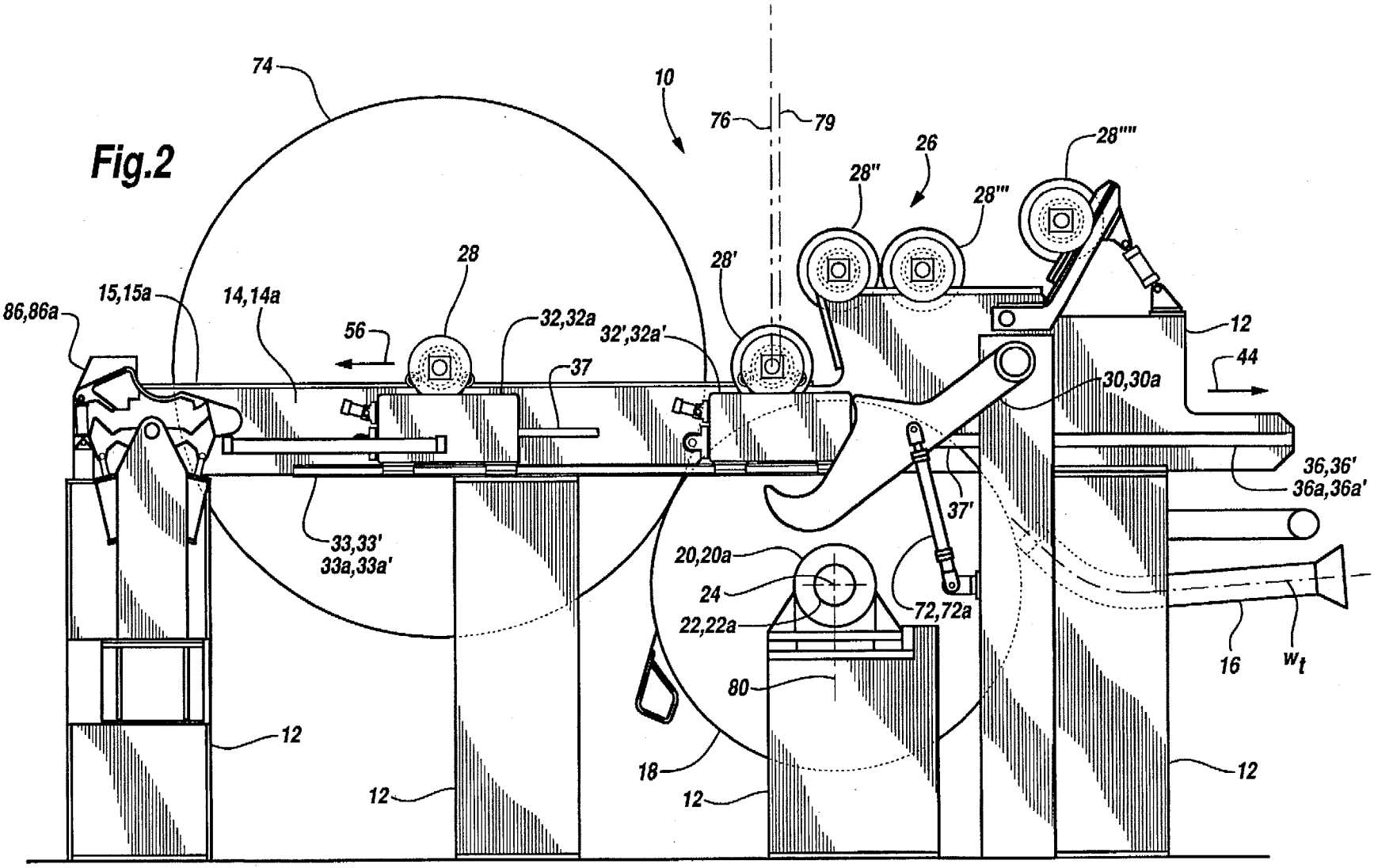
FIG. 2 is a side-elevational view, similar to that shown in FIG. 1, wherein the pivot arms for bringing a new reel spool into position have continued their pivotal movement in their sequence of operation to a position below the horizontal rails.
Figure 3:
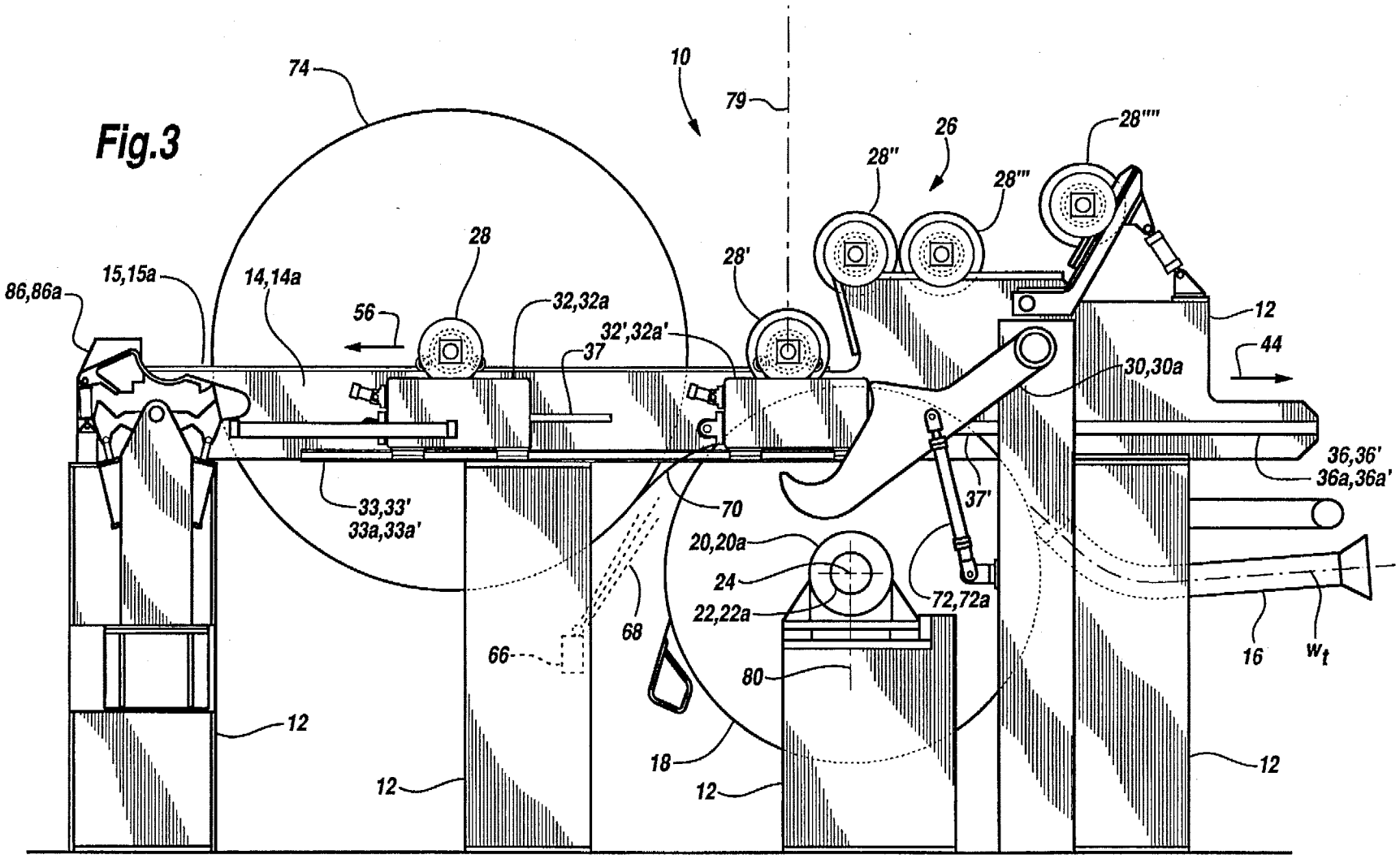
FIG. 3 is a side-elevational view, similar to that shown in FIG. 1, which also shows the beginning of the paper web turn-up procedure between the finished wound web roll and the new reel spool.

A reel, generally designated with the numeral 10, includes a frame 12 on which a pair of spaced, parallel, horizontal rails 14,14*a*, having top surfaces 15,15*a*, are mounted.

In this apparatus, both the front side, as shown in FIGS. 1–6, and the back side, not shown in FIGS. 1–6, are essentially identical, so reference will be made to only the front side shown, even though substantially identical back side components, such as rail 14*a*, which are identified with a small letter suffix, may be designated, but not shown. It is, therefore, to be understood and intended that the corresponding apparatus elements on the back side of the apparatus are to be included in the description and recitation of the invention.

A so-called paper web tail guiding apparatus 16 is mounted to the frame to guide the on-coming paper web tail $W_t$ onto the surface of a support drum 18. The support drum is fixedly mounted in bearings 20,20*a* in the frame 12 to rotate on its journals 22,22*a* about its horizontal axis of rotation 24.

A storage station 26 for storing a supply of new reel spools 28,28' and 28", etc., is mounted to the frame to locate the supply of new reel spools above the support rails 14,14*a* and the upper surface of the support drum. A pair of spool arms 30,30*a* are mounted on the frame beneath the reel spool storage station to pivot between a spool receiving position to receive a new reel spool onto the arms from the reel spool storage station, and to pivot downwardly to deposit the new reel spool to be supported on the horizontal rails 14,14*a*.

Figure 8A:
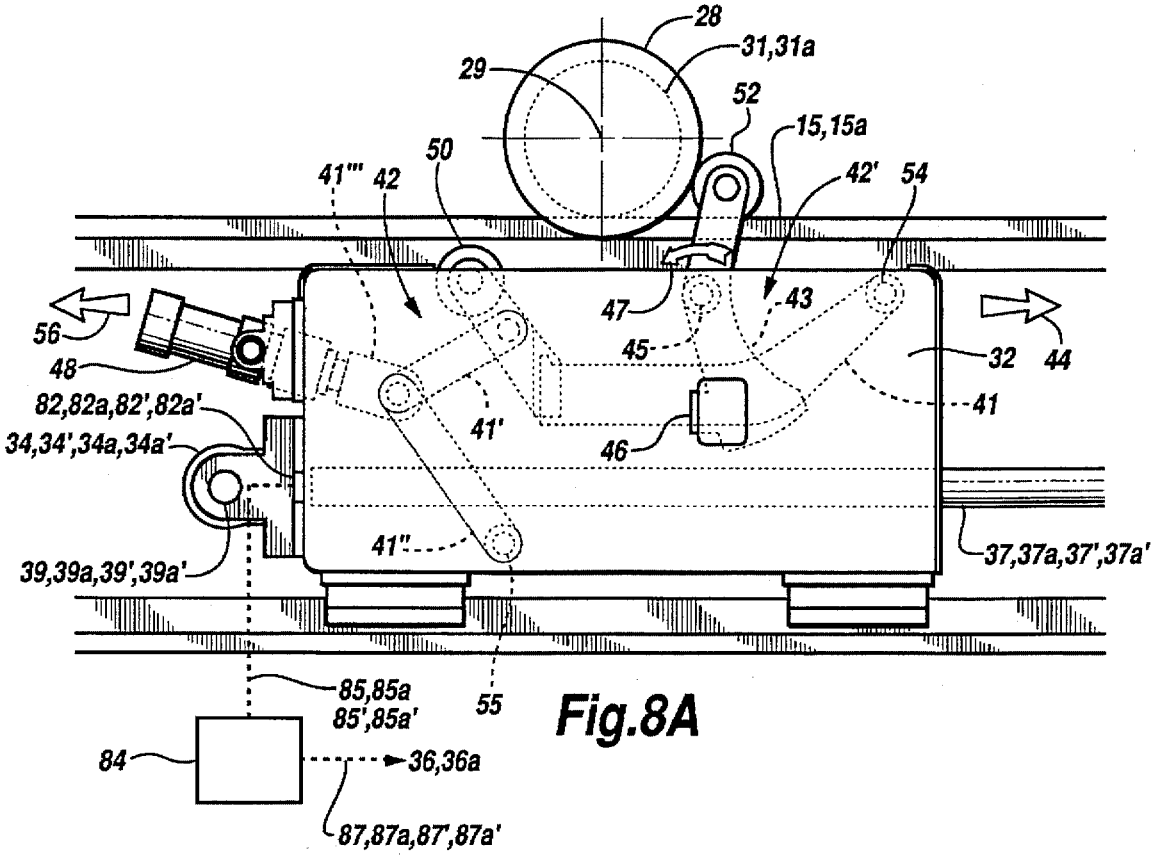
FIGS. 8A and 8B are a side-elevational view, and a front elevational view, respectively, of the toggle apparatus and the carriages which are mounted on guides located on the inside and outside of the rail on both the front and back of the reel apparatus to guide the carriages parallel to the rails supporting the reel spools.
Figure 8B:
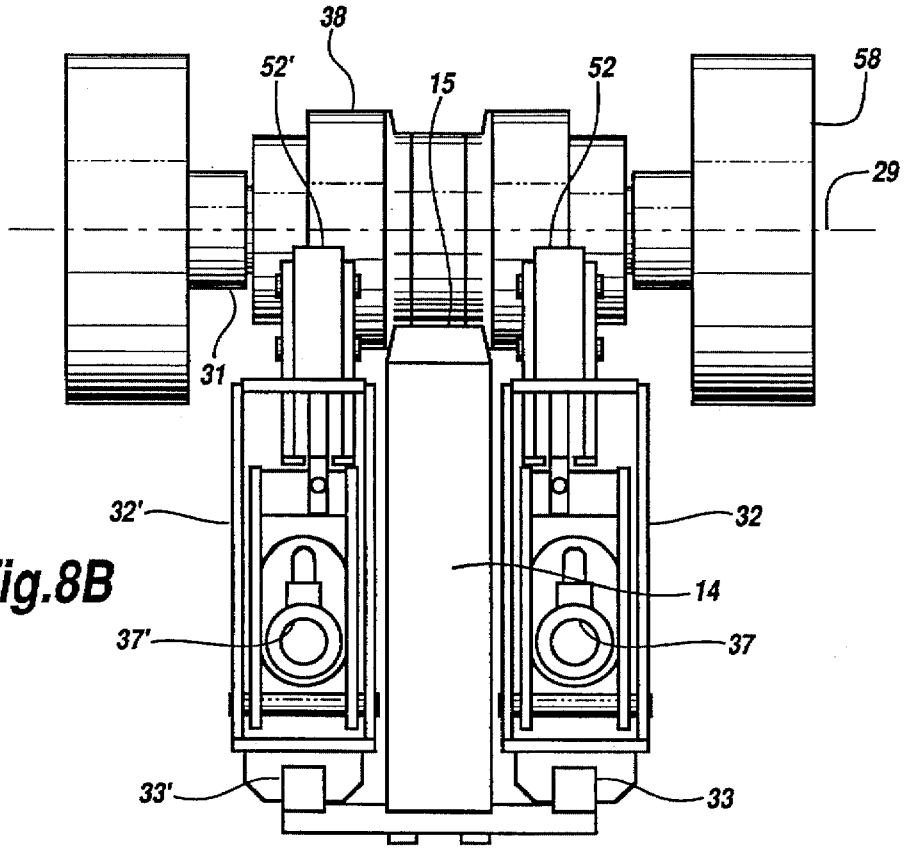

Referring to FIGS. 1, 8A and 8B, inner and outer carriages 32,32'; 32*a*,32*a'* are mounted on either side of each of the front and back side rails 14,14*a*. The ends 34,34'; 34*a*,34*a'* of corresponding actuators 36,36'; 36*a*,36*a'*, preferably a hydraulic cylinder, are connected to their respective carriages 32,32'; 32*a*,32*a'*. In this manner, four carriages can be mounted for reciprocal movement on guides 33,33'; 33*a*, 33*a'* which extend beside and along the rails, and parallel to the rails, on the front and back sides of the reeling apparatus. The inner carriage on one side of the reel apparatus is operatively linked with the outer carriage on the other side of the reel apparatus. In this manner, as will be explained in more detail subsequently, two sets of cooperating pairs of carriages are operatively associated to move two reel spools along the single set of two rails 14,14*a*.

While the actuators 36 preferably are hydraulic cylinders, other equivalent actuators are contemplated, such as ball screw and chain and sprocket apparatus.

While the weight of the reel spool and the paper roll being wound is supported by the horizontal rails 14,14*a*, rotational support and longitudinal positioning of the reel spools horizontally along the rails is provided by the pairs of carriages, with one carriage supporting one end of each reel spool. This is effected by a bearing housing 38 (FIG. 8B) mounted on each end of each reel spool. The reel spool journals 31,31*a* are rotatably mounted in the bearing housings which do not themselves rotate. Each bearing housing is clamped in place in a carriage by being positioned between toggle apparatus 42,42' on either side of the bearing housing (FIG. 8A). The pivoted toggle apparatus 42' on the upstream side of the reel spool bearing, having linkages 43,43' pivotally mounted about pin 45 in the direction of upstream arrow is mounted such that it is fixed against a stop 46 to prevent movement of the reel spool in the upstream direction 44. Toggle apparatus 42 includes linkages 41,41', 41",41'". Actuation of the actuator (hydraulic cylinder) 48 on the toggle apparatus 42 on the other side of the reel spool raises the roller 50 to engage the reel spool in a secure position relative to the carriages 32,32*a* holding the reel spool for movement longitudinally along the rails. Roller 52 on the other toggle apparatus 42 bears against the other side of the reel spool to maintain the reel spool in position in the carriage through its bearing housing.

With reference to FIG. 8A, when the actuator 48 is deactivated, linkage 42 is pivoted around pins 54,55 to lower the rotatable roller 50 at the end of the linkage to permit the reel spool to be removed from its pair of carriages downstream, in the direction of arrow 56, when the piston 37 of the actuator 36 attached to the carriage through a pin 39 pushes the hydraulic cylinder and the other toggle apparatus 42' on the upstream side of the reel spool is fixed in its stop 46 with its roller in rotatable supporting, and longitudinal moving, engagement with the reel spool.

As shown in FIG. 8B, carriages 32,32' on one side of the apparatus are actually supporting the ends of two different reel spools, one behind the other, so they are not both shown, One of the reel spools can be a new reel spool which has just been deposited into its ready position to begin the procedure whereby the on-coming paper web is turned up upon it to begin the winding of a new wound web roll, while the other reel spool can be supporting a web roll being wound or finished being wound.

The toggle arrangement on each carriage, described above in conjunction with FIG. 8A, permits one set, or pair, of carriages which have been supporting a completed wound paper web roll to be moved upstream, in the direction of arrow 44, past the set, or pair, of carriages which are supporting another paper web roll as it is being wound. This is accomplished by the fact that a weighted arm 43, pivotally mounted about a pin 45 in each carriage permits the toggle apparatus 42' to pivot in the direction of arrow 47 downwardly beneath its rail as the carriage 32 on which the toggle apparatus is mounted is moved upstream in the direction of arrow 44. Conversely, when the carriage is supporting a reel spool for rotatable movement, with the reel spool bearing housing clamped between the rollers 50,52, the reel spool/wound web roll cannot move upstream due to the toggle apparatus 42' being held against stop 46 and the toggle apparatus 42 being held in position by the activated actuator 48.

In this manner, two sets of a complimentary pair of carriages can be disposed about a single pair of rails 14,14*a* to handle two different reel spools simultaneously as one reel spool begins the web reeling process and the other reel spool is finished being wound.

In order to support each reel spool for the same distance, or span, between its ends, while utilizing only one pair of rails 14,14*a*, and further in conjunction with the unique construction of the carriages 32,32*a*; 32',32*a'*, the carriage 32, shown in FIG. 8B, on the outside of the support rail 14 on the front of the reel apparatus is paired with a carriage 32*a* which is mounted on the inner side of the rail on the back side of the reel apparatus. Similarly, carriage 32' on the inner side of rail 14 on the front side of the reel apparatus is paired with the carriage 32*a'* which is mounted on the outside of rail 14*a* on the back side of the reel apparatus.

Each reel spool has a shroud 58 or 58*a* on its end which is concentric with the rotational axis 29 of the reel spool. This shroud is engageable by a mating couple 60 on a centerwind assist drive apparatus 62 which is shown in FIGS. 7A, 7B and 7C.

Figure 4:
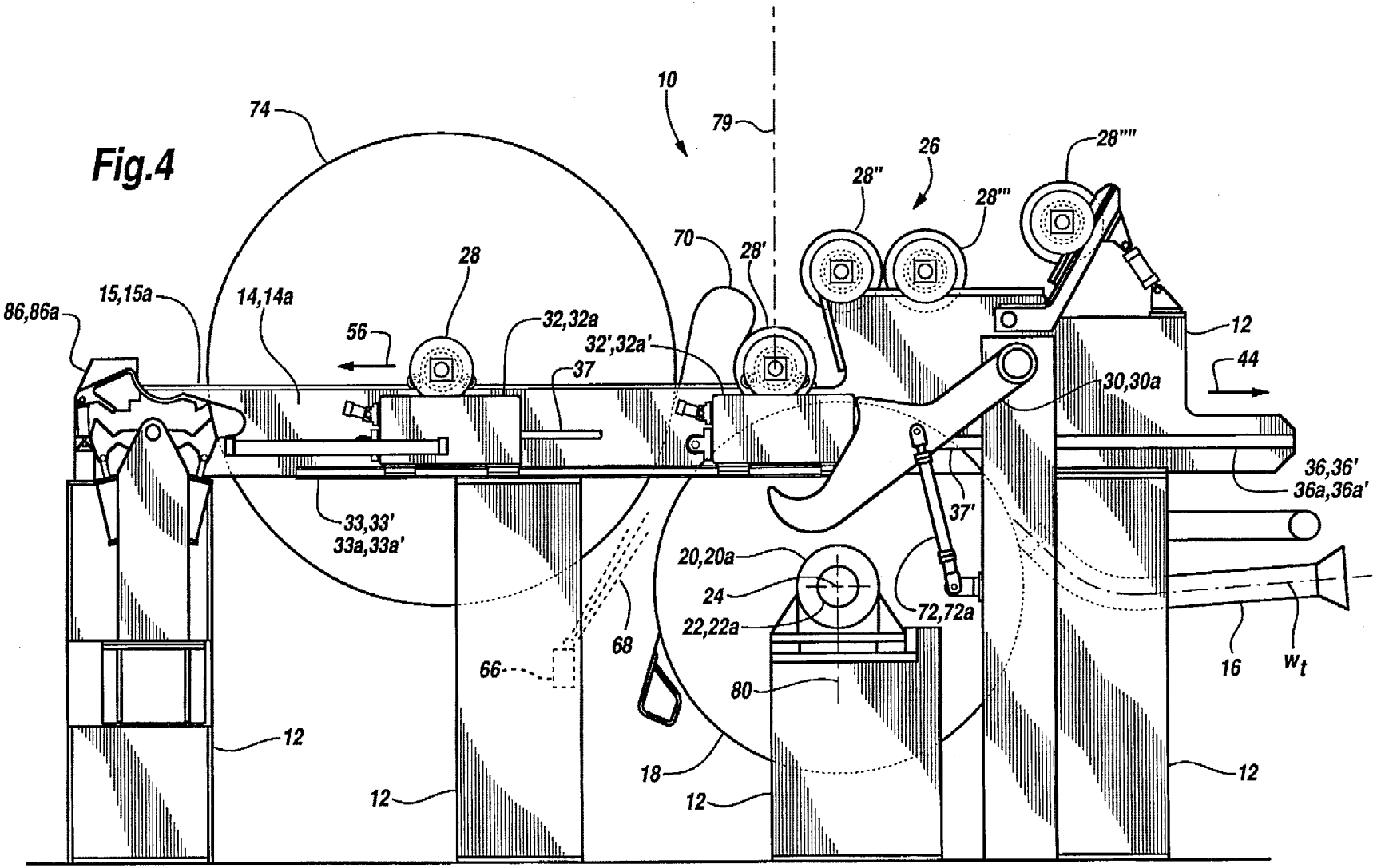
FIG. 4 is a side-elevational view, similar to that shown in FIG. 1, which shows the web bubble created as the web is advanced into its turn-up position on the new reel spool.
Figure 5:
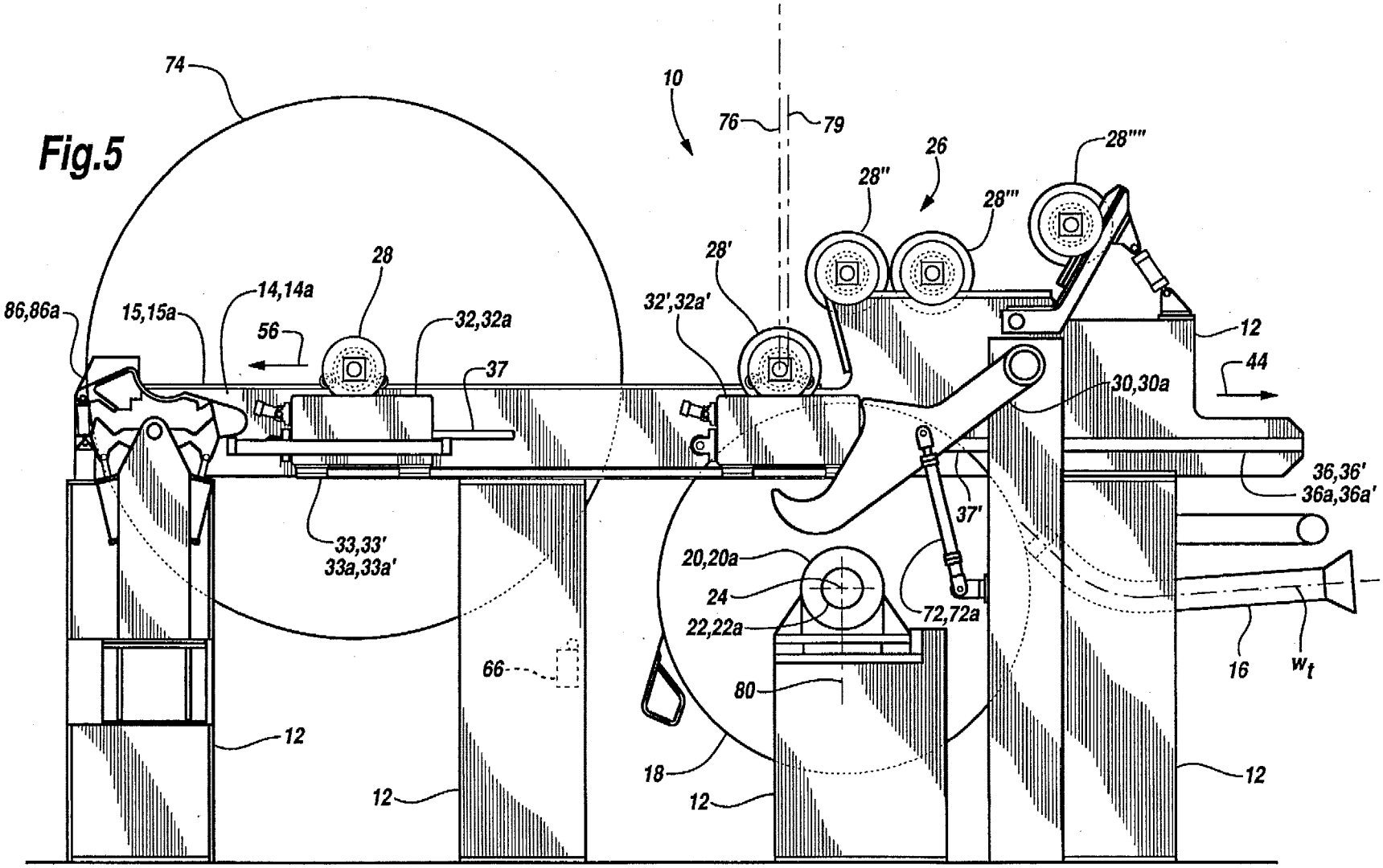
FIG. 5 is a side-elevational view which shows the finished wound paper web roll at a position spaced from nipping engagement with the support drum and showing the beginning of the new web roll being wound in nipping engagement with the support drum.
Figure 6:
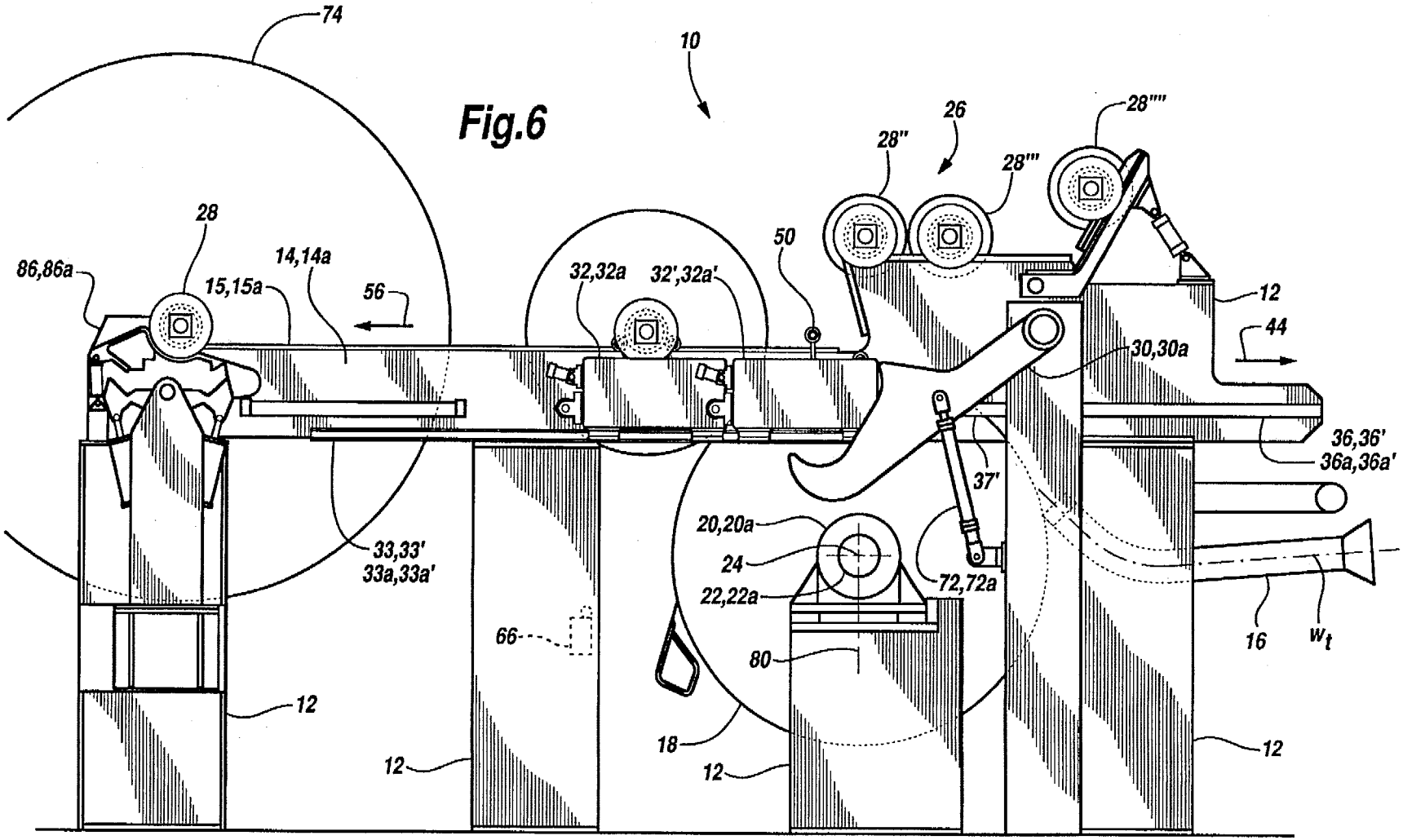
FIG. 6 is a side-elevational view showing a finished wound paper web roll at its removal station at the end of the support rails and showing the new web roll being wound at a point where it is about half wound.

FIG. 4 illustrates schematically the paper web turn-up apparatus. This apparatus includes one or more nozzles 66 direct a stream of compressed air, designated with the numeral 68, to urge the traveling web to form a looped bubble 70 as part of the web turn-up procedure. The looped bubble is encouraged to wrap the reel spool by the addition of glue to the top of the paper web from nozzles 81, or by the application of vacuum to the reel spool.

The arms 30,30*a* which pivot to receive a new reel spool and to lower the new reel spool onto the support rails 14,14*a* are actuated by a pair of hydraulic cylinders 72,72*a*.

Figure 7B:
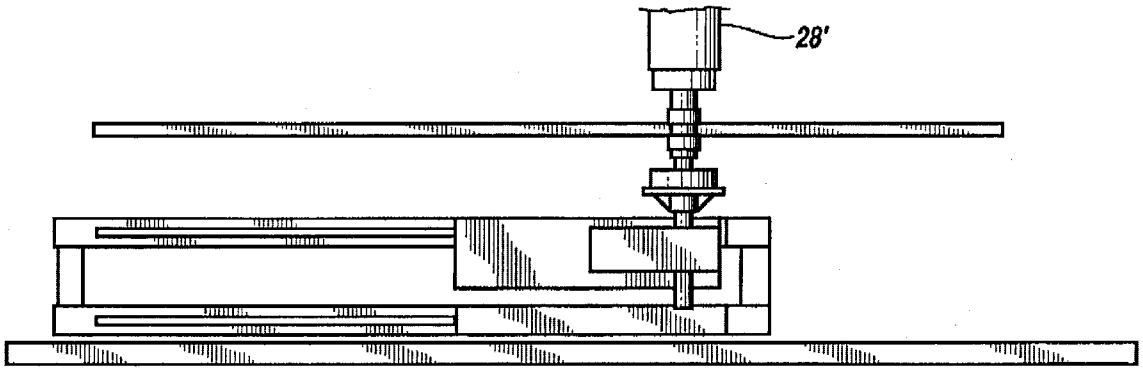
FIGS. 7A, 7B and 7C show a side-elevational view, a top view, and a front view, respectively, of the centerwind assist drive which is located on both sides of the reel apparatus for engaging successive reel spools on alternate ends when the reel spools are supported on the horizontal rails and rotatably supported in the carriages on either side of the apparatus. In these figures, only one such centerwind assist drive is shown for clarity.
Figure 7A:
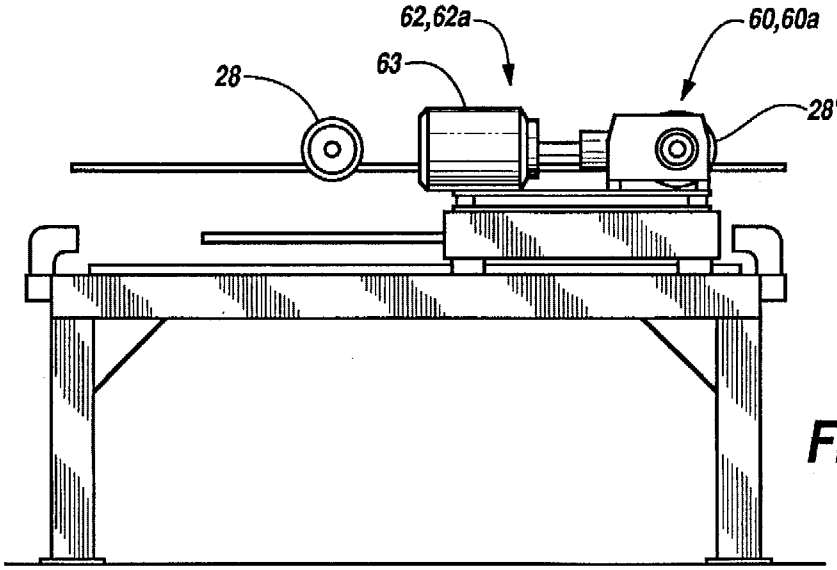
Figure 7C:
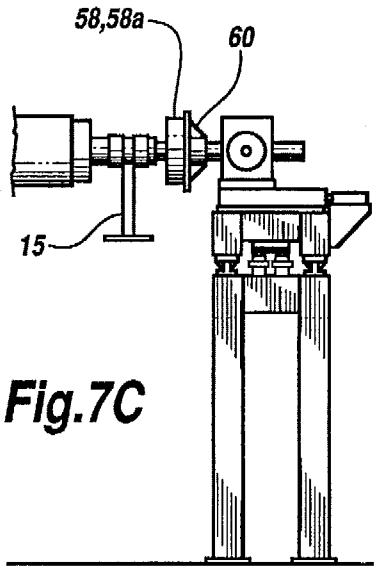

Referring to FIGS. 7A, 7B and 7C, a centerwind assist drive 62,62*a*, including a motor 63, is located on both the front and back sides of the reel apparatus, although, for simplicity, the centerwind assist drive is only shown on one side in these figures. These centerwind assist drives 62,62*a* are mounted for both reciprocal movement longitudinally along the rails 14,14*a*, parallel therewith, as well as for movement transversely to their longitudinal movement so as to move their coupling apparatus 60,60*a* into and out of engagement with the shroud on a reel spool. Thus, the centerwind assist drive can engage a new reel spool when it has been deposited on the rails 14,14*a* and follow the reel spool to any position along the rails from the time when the on-coming paper web is wrapped onto a new reel spool until the time that a paper web roll has finished being wound.

The operation of the web turn-up apparatus and centerwind assist drive apparatus 62,62*a* is known in the papermaking industry and is shown and described in the previously cited U.S. Pat. No. 5,370,327 by Adamski. To the extent that it needs to otherwise be described and explained, reference can be had to this Adamski patent, the disclosure of which is hereby incorporated by reference.

Figure 9:
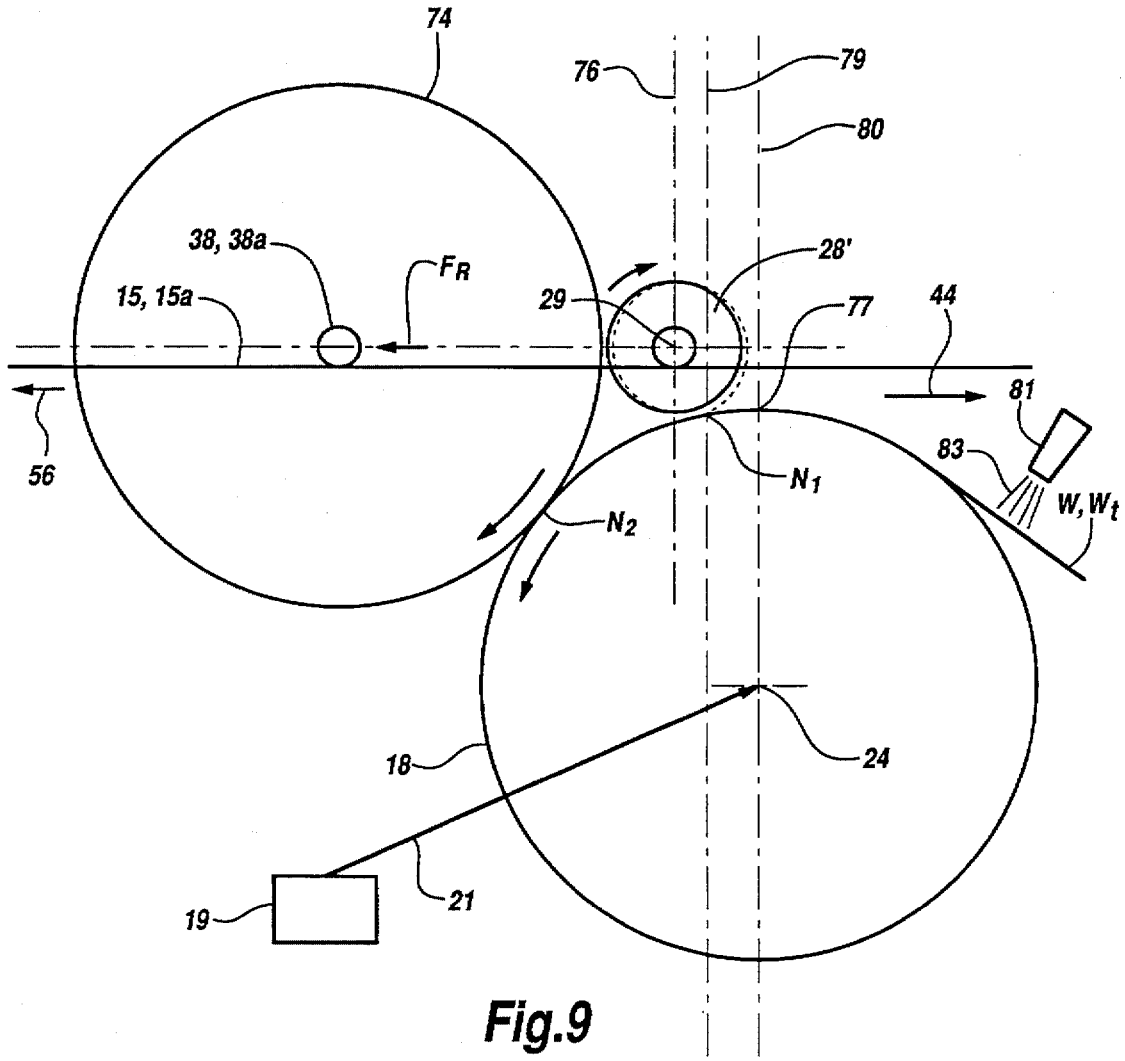
FIG. 9 is a schematic illustration of the support drum, new reel spool in its ready and reeling (dashed lines) positions on the horizontal rails, and the web roll being wound. The geometry between the support rail, new reel spool, support drum and the web roll being wound is shown.

Referring to FIG. 9, support drum 18 is fixedly mounted to rotate about its axis of revolution 24. It is rotatably driven by motor 19 which is operatively linked (shown schematically at 21) with the support drum journal 22. A web roll 74 being wound is shown with the journals 31,31*a* of its reel spool 28 supported on the tops 15,15*a* of rails 14,14*a*. A reel spool 28 is shown in solid line with its journals 31,31*a* horizontally supported on the tops of the rails. Reel spool 28, having been lowered onto carriages 32,32*a* on the rails by the spool loading arms 30,30*a*, is a so-called new reel spool in that it is engaged by the reel spool loading arms for the purpose of initiating a new wound paper web roll. The new reel spool is initially positioned by the loading arms into a ready position on the carriages with its axis of rotation 29 in a vertical plane 76. In this ready position, with its bearing housings 38,38*a* supported in carriages 32,32*a*, the reel spool is not in contact with either the paper web 74 being wound or the support drum 18. Preferably, the gap between the new reel spool, wound web roll and the support drum is about 10 mm. While the new reel spool remains in position where it is not engaged with either the paper web roll being wound or the support drum, its shroud 58,58*a* on a journal at one end of the reel spool is engaged by the coupling 60,60*a* on a centerwind assist drive to rotatably drive the reel spool up to a desired rotational speed (i.e. speed control), such as the speed of the rotating support drum. The particular centerwind assist drive coupled to a shroud on one end of the new reel spool is on the side of the reel apparatus on the opposite side from the centerwind assist drive which is driving the reel spool on which the paper web roll 74 is being wound. In other words, the centerwind assist drives are positioned on each side of the reel apparatus and engage the ends of successive reel spools on alternate sides of the reel apparatus.

In the ready position, the axis of the new reel spool in plane 76 is downstream of the apex 77 of the support drum, which is in vertical plane 80.

The operation of the reel apparatus can be described either on the basis of continuing operation (FIGS. 1–6, 9) or on the basis of when an initial paper web tail $W_t$ is produced upstream of the apparatus and is brought into the reel apparatus via tail guide 16. Except for the initial tail-threading procedure, which is of no significance to the invention, the operation is one and the same.

In continuing operation, when a jumbo wound paper web roll 74 is nearing its desired finished diameter in nipping position $N_2$, actuators 36,36*a* are activated (i.e. position control) to move wound roll 74 downstream about 200 mm from where it is in nipping engagement $N_2$ with the support drum.

Spool loading arms 30,30*a* engage a new reel spool from the spool storage station 26 and rotate downwardly past the rails to deposit a new reel spool in a cooperating pair of carriages. Toggle apparatus 42,48 is activated to hold the new reel spool between rollers 50,52 in the toggle apparatus 42,42'.

A centerwind assist drive is then brought into operating engagement with the new reel spool, and the new reel spool is brought up to a desired speed.

When a new reel spool has been operatively connected with a centerwind assist drive to bring it up to desired rotational speed, in a preferred embodiment, actuators 36,36*a* are activated to move the carriages supporting the new reel spool upstream in the direction of arrow 44 in position control. Once the new reel spool has reached a desired nipping engagement $N_1$ (i.e. reeling position) with the support drum, the control changes to load control. The preferred initial nip between the new reel spool and the support drum is about 0.35 Kn/m to about 0.53 Kn/m. Nip $N_1$ is in a vertical plane 79 which is upstream of plane 76 and downstream of the apex 77 of the support drum 18. When the new reel spool is in nipping position $N_1$ (i.e. load control by the positioning actuators 36,36*a*), the centerwind assist drive on the new reel spool is in surface speed, or load sharing, relationship with the motor 19 which drives support drum 18 through a link schematically shown at 21. This control status remains until the web roll 74 being wound reaches jumbo roll size and is removed from nipping engagement $N_2$ with the support drum, as will be described in more detail later.

The turn-up apparatus (i.e. air nozzles 66 and the directed compressed air stream 68) is then activated (FIGS. 3 and 4) in conjunction with air nozzles 66 and the centerwind assist drive, which is rotatably driving wound web roll 74 such that the speed of the wound web roll 74 is reduced relative to the speed of the new reel spool to create a web loop, or bubble 70, extending upwardly in an unsupported span between the web roll 74 being wound and the new reel spool. A glue applicator 81 (FIG. 9) may be activated to apply glue 83 to the top of the on-coming web upstream of nip $N_1$. The turn-up apparatus is activated at about the same time as the glue applicator to urge the looped, or bubble, portion of the on-coming traveling web W about the peripheral surface of the new reel spool to be wrapped thereon. Once the on-coming web W is wrapped upon the new reel spool, preferably with the aid of the glue, the web is broken due to the tension created by the counter-rotating directions of the wound web roll 74 and the new reel spool 28.

In the case where a new reel spool represents the initial paper web roll to be wound, that is, there is no preceding web roll 74 being wound, a paper tail $W_t$ is created upstream of the reel apparatus and is guided into the reel apparatus by tail guide 16 and onto and about the surface of the new reel spool by activation of the glue apparatus 81. The glue applicator is activated to apply glue to the top surface of the tail, as desired, in the same manner in which glue may be applied to the full width web as described above. The new reel spool would have been previously brought up to speed and brought into nipping engagement with the support drum as described above.

Due to the unique position of the tops of the support rails above the apex 77 of the support drum, the dimensional geometry of 1) the wound web roll 74, when it is near, or has reached, its desired finished diameter; 2) the diameter of the reel spool; 3) the diameter of the support drum, the invention is capable of reeling a web roll and preparing for the commencement of reeling the web onto a new reel spool to begin a new web roll simultaneously, with both such rolls positioned downstream of the apex of the support drum. In a preferred embodiment of the invention, when the wound web roll 74 has reached a diameter of about 2 m, or larger, and the diameter of the new reel spool is about 48 cm, or smaller, and the diameter of the support drum is about 213 cm, for example, the new reel spool can be both brought into supporting engagement with the carriages without being in nipping engagement with either the web roll 74 or the support drum while the web roll 74 remains in nipping engagement $N_2$ with the support drum. The space, or gap, between the peripheral surfaces of the new reel spool positioned in its ready position in an pair of cooperating carriages on the rails and the wound web roll and the support drum might be, for example, about 10 mm. This permits the new reel spool, and the paper web which has begun to be wound thereon, as explained above, to be brought into nipping engagement (initial reeling position $N_1$) with the support drum such that the newly started web roll on the new reel spool 28 has begun to be wound while the web roll 74, having first been finished, is still supported on the rails preparatory to being removed from the reel apparatus. This greatly enhances the reeling efficiency and control of the reel apparatus and method.

As previously described, while there is only one pair of rails 14,14*a*, there are two pairs of carriage guides 33,33*a* and 33',33*a'*. This permits successive reel spools to be mounted with their bearing housings 38,38*a* on either end of the reel spools to be mounted in successive corresponding pairs of carriages 32,32*a* and 32',32*a'*. In turn, each of these pairs of carriages is powered for reciprocal movement about their carriage guides 33,33*a* and 33',33*a'*. Thus, actuators 36,36*a*; 36',36*a'* through their pistons, or rods, 37,37*a*; 37',37*a'* are connected to their corresponding carriages 32,32*a* and 32',32*a'* via their respective pins 39,39*a*; 39',39*a'* to position the carriages, as desired.

In a preferred embodiment, each of the links between the pistons 37,37*a*; 37',37*a'* and the carriages is connected via sensors 82,82*a*; 82',82*a'* (shown schematically in FIG. 8A) which can emit signals which are a function of the reactive force on the sensors when the reel spools mounted in the carriages are nipped against the support drum. Since the geometry between the support drum and the location of the web roll being wound, according to its diameter, when it is in nipping engagement with the support drum, is known, and an algorithm can be devised to express such a relationship mathematically, these signals can be correlated by a control instrument 84 programmed with the algorithm to both provide a signal, which is an indication of the nip load, or nip pressure, and compare the nip load signal with a desired nip load at the particular diameter of the web roll being wound. The actuators are then operated to bring the actual nip load (pressure) into conformity with the desired nip load preprogrammed in the control instrument for the operating parameters existing at that particular time in the operating cycle. For example, a desired nip load $N_2$ on an established web roll 74 as it is being wound might be between about 0.175 to about 0.53 Kn/m. A schematic representation of this control is shown in FIG. 9 wherein the reaction force $F_R$ on the carriage produces a signal 85,85*a*; 85',85*a'* by the sensors 82,82*a*; 82',82*a'* (FIG. 8A) which is sent to the control instrument 84 which, in turn, signals 87,87*a*; 87',87*a'* the actuators 36,36*a*; 36',36*a'* to produce the force required to provide the desired nip pressure $N_1$ or $N_2$ at the desired diameter of the new web roll according to a preprogrammed desired value for the nips $N_1$ and $N_2$ which is desired for the web roll being wound at that particular diameter when the reading is taken.

The apparatus for the sensors 82,82*a*; 82',82*a'*, instrument 84 are known to those skilled in the art, so they, and the manner in which they are used, will not be discussed further.

In a similar manner, it is contemplated that the sensors could be operatively linked with the support drum mounting and be calibrated such that their signals to the control instrument 84 and actuators 36,36*a*; 36',36*a'* would be indicative of the nip pressure $N_1$ or $N_2$.

When the web roll 74 being wound has reached its desired, finished diameter, the actuators 36 are activated to move the wound web roll an additional distance beyond the first 200 mm when the web bubble was created for the start of a new reel spool. This additional distance is about 200 mm short of the maximum extension of pistons 37,37*a*; 37',37*a'*. At this time, the centerwind assist drive on roll 74 is disengaged. The wound web roll is still positioned along the horizontally disposed rails 14,14*a*.

When the wound web roll is desired to be removed from the reel apparatus, the actuators move their pistons to push the carriages on which the wound web roll is mounted a further 150–200 mm to propel the jumbo roll to a stop 86,86*a* at the end of each rail 14,14*a*. In this last ejection movement distance of about 150–200 mm, or so, the rails 14,14*a* may slant downwardly very slightly, such as at about 0.5° to the horizontal, to ensure that the finished wound web roll remains in contact with the stops at the ends of the rails. The rails are, of course, still substantially horizontally disposed.

It is also contemplated that the rails 14,14*a* could be horizontal for their entire length, or sloped near their ends, and the finished wound web roll would have its journals or bearing housings engaged by spring loaded toggles mounted on rodless pneumatic cylinders which would be actuated to follow the jumbo roll and ensure that it doesn't stop on the rails before it reaches the stops at the ends.

At this time, when the finished roll is desired to be removed, the carriages on which the finished wound web roll is mounted, carriages 32,32*a*, for example, have their actuators 48 activated to retract toggle apparatus 42 to bring the rollers 50 downwardly beneath the tops 15,15*a* of the rails. Actuators 36,36*a* are then activated to retract pistons 37,37*a* so that carriages 32,32*a* are retracted upstream in the direction of arrow 44 (FIG. 8A). In the meantime, the other pair of cooperating carriages 32',32*a'*, which are supporting the latest new reel spool in nipping position $N_2$ with the new web roll, are in position on their guides 33',33*a'*. With their toggle apparatus 42 and rollers 50 in a retracted position, toggle apparatus 42', comprising weighted arm 43 and link 43' on which roller 52 is mounted on the downstream pair of carriages 32,32*a* which are moving upstream, engages the bearing housing 38,38*a* (FIG. 8B) on the latest new reel spool in carriages 32',32*a'* in position $N_2$ and is deflected thereby downwardly in the direction of arrow 47 about pivot pin 45 as they pass upstream to the ready position to receive the next new reel spool. In this manner, the corresponding pairs of carriages 32,32*a* and 32',32*a'* can reciprocate back and forth and bypass one another when the carriages supporting web rolls being wound or have been finished wound are traveling in the downstream direction 56 while the cooperating pairs of carriages from which the finished wound paper web roll has been removed are moving upstream in the direction of arrow 44 to receive a new reel spool.

As can be understood from the preceding description, the nipping engagement of a reel spool against the support drum begins with the reeling position $N_1$ and continues without interruption in a controlled manner as the initial nipping engagement $N_1$ becomes nip $N_2$ substantially immediately after the traveling paper web is transferred onto a new reel spool. Nip $N_2$ then migrates downstream about an upper peripheral segment of the support drum surface while the paper web roll being wound grows in diameter while remaining horizontally supported for translational movement along the rails.

Thus, a new method and apparatus has been described which provides the features and advantages of this invention. The wound paper web roll is controllably driven from the time a new reel spool is brought into ready position until the jumbo roll is finished being wound. The web roll being wound remains horizontally disposed downstream from the apex of the support drum at all times during the formation of the wound web roll. Control of the speed and nip between the web roll being wound and the support drum is maintained at all times, and there is no transfer of the wound web roll from one nip-actuating apparatus, such as a cooperating pair of carriages, to another during the entire process of reeling the wound web roll. Two cooperating pairs of carriages are utilized in conjunction with a single pair of horizontally disposed rails which have their top surfaces positioned above the apex of the support drum.

What is claimed is:

1. Apparatus for reeling a traveling paper web into a wound web roll on a reel spool having a journal at either end thereof, the apparatus having front and back sides and comprising, in combination:

a frame;

a support drum, having an axis of revolution, rotatably mounted to the frame in a fixed position with its axis of revolution horizontally disposed;

support drum drive means operatively linked with the support drum for rotatably driving the support drum;

a pair of parallel, substantially horizontally disposed rails mounted to the frame with the top surfaces of the rails located above the apex of the support drum surface with one rail mounted at each of the front and back sides of the apparatus, the rails extending from spool-supporting proximity of the reel spool with the support drum surface downstream in the direction of travel of the on-coming web;

carriage guide means operatively associated with each of the rails for supporting carriages for longitudinal movement parallel with each of the rails;

a pair of cooperating carriages, each of said carriages mounted on a carriage guide means associated with a corresponding rail, each carriage initially selectively positionable for receiving a new reel spool in a ready position downstream in spaced adjacency relative to the support drum and for being subsequently positionable upstream of the ready position and into nipping engagement with the support drum for receiving the traveling web to be wound into a wound web roll thereon, the ready position being downstream of the apex of the support drum surface;

centerwind drive means for selectively engaging and rotatably driving the said new reel spool when the said new reel spool is supportingly mounted in the said pair of carriages;

position means for selectively 1) positioning the said pair of carriages into the said ready position relative to the support drum to receive a new reel spool for reeling the traveling web onto the said new reel spool, the said ready position being downstream of the apex of the support drum, 2) positioning the said pair of carriages supporting the new reel spool into a reeling position where it is downstream of the apex of the support drum surface and in nipping engagement with the support drum for reeling the traveling web into a wound web roll thereon, and 3) controllably positioning the said pair of carriages downstream to control the nip pressure between the web roll being wound and the support drum during the reeling of the wound web roll, and to move the wound web roll from nipping engagement with the support drum, as desired;

whereby the wound web roll is moved downstream while being horizontally supported, rotatably driven, and in controlled nipping engagement with the support drum, continuously until the desired diameter wound web roll is reached.

2. Apparatus for reeling a traveling paper web, as set forth in claim 1, further including:

a storage station for storing a plurality of new reel spools;

reel spool loading arm means mounted to the frame for engaging and carrying a new reel spool from the storage station, and for depositing the new reel spool onto a cooperating pair of carriages in the ready position.

3. Apparatus for reeling a traveling paper web, as set forth in claim 1, further including:

a second pair of cooperating carriages, one carriage of said second pair of carriages mounted on a second carriage guide means associated with a corresponding rail of said pair of rails, each carriage of said second pair of carriages selectively positionable for receiving a new reel spool in the ready position relative to the support drum to subsequently receive the traveling web to be wound into a web roll thereon while the said pair of cooperating carriages are selectively positioned by the said carriage guide means to either 1) maintain the reel spool on which the web roll is being wound when the said new reel spool is in the ready position; or 2) move the finished wound web roll out of nipping engagement with the support drum when the second carriage guide means actuate the said second pair of cooperating carriages to nip the new reel spool with the support drum.

4. Apparatus for reeling a traveling paper web, as set forth in claim 3, further including:

toggle means operatively associated with each carriage in both the said pair and said second pair of cooperating carriages, the toggle means being so constructed and arranged as to be actuatable to secure the reel spool in the said pair and said second pair of cooperating carriages when the position means moves the carriages in the upstream and downstream directions when the cooperating carriages are supporting a reel spool, and de-actuatable to permit a cooperating pair of carriages from which the finished wound web roll has been removed to bypass the other cooperating pair of carriages which are supporting a reel spool.

5. Apparatus for reeling a traveling paper web, as set forth in claim 1, further including:

air means for directing a stream of pressurized air against an unsupported span of traveling web which has been created between the web roll being wound and a new reel spool which has been located in the ready position.

6. Apparatus for reeling a traveling paper web, as set forth in claim 1, further including:

nip sensor means operatively associated with the apparatus and the position means for determining the nip pressure between the paper web roll being wound and the support drum, and for producing a signal indicative of the said nip pressure;

control instrument means for receiving the signal and for comparing the said nip pressure with a predetermined value provided to the control instrument means, and for signaling the position means to move the carriages supporting the wound web roll so as to bring the actual nip pressure between the support drum and the web roll being wound into conformity with the desired nip pressure.

7. Apparatus for reeling a traveling paper web, as set forth in claim 1, further including:

turn-up means operatively associated with the apparatus for cooperating with the apparatus to produce a bubble in the traveling paper web downstream of the new reel spool, and for encouraging the bubble formed in the traveling paper web to wrap the new reel spool to begin being wound thereon to begin the formation of a web roll on the new reel spool.

8. A method for reeling a traveling paper web into a wound web roll on a reel spool having a journal at either end thereof, the method utilizing a support drum for nipping engagement with the web roll and a new reel spool, comprising the steps of:

supporting a new reel spool in a ready position for rotation, and for translational movement substantially horizontally, the ready position being downstream of the apex of the support drum surface such that the new reel spool is in spaced adjacency with the support drum;

engaging the support drum with a drive means for rotatably driving the support drum;

selectively engaging a journal at one end of the new reel spool in the ready position with a centerwind drive means for rotatably driving the new reel spool and bringing it up to a desired speed;

positioning the new reel spool into a reeling position in nipping engagement with the rotatable support drum, which support drum is fixedly mounted in a frame to rotate about a horizontally disposed axis of rotation thereof, the reeling position also being downstream of the apex of the support drum surface relative to the direction of the traveling web;

directing the on-coming traveling web into the nip between the new reel spool and the support drum;

reeling the traveling web onto the new reel spool to begin the formation of a wound web roll thereon;

maintaining horizontal support of the wound web roll as its increasing diameter allows the wound web roll to move translationally downstream of the support drum:

selectively maintaining controlled nip pressure between the paper web roll being wound and the support drum;

maintaining rotational drive of the new reel spool of the web roll as it is wound to desired wound web roll diameter;

supporting another new reel spool in the ready position for rotation, and for translational movement substantially horizontally, while maintaining nipping engagement between the web roll being wound and the support drum, the said another new reel spool being in spaced adjacency with both the support drum and the web roll being wound while in the ready position;

selectively engaging a journal at an alternate end of the said another new reel spool, relative to the end of the preceding said new reel spool engaged by a centerwind assist drive means, with another centerwind drive means for rotatably driving the said another new reel spool and bringing it up to a desired speed;

removing the wound web roll from nipping engagement with the support drum when the wound web roll has reached a desired diameter;

positioning the said another new reel spool in a reeling position in nipping engagement with the support drum;

severing the traveling paper web from the web roll being wound to produce a finished wound web roll;

transferring the traveling paper web onto the said another new reel spool;

removing the finished wound web roll from its horizontal support while the traveling web is reeled onto the said another new reel spool.

9. A method of reeling a traveling paper web, as set forth in claim 8, wherein:

the reeling position is initially at, or upstream of, the ready position, relative to the direction of the traveling paper web, and the reeling position remains downstream of the apex of the support drum;

the ready position is downstream of the apex of the support drum surface.

10. A method of reeling a traveling paper web, as set forth in claim 8, wherein:

the selective maintaining of controlled nip pressure between the web roll being wound and the support drum includes the steps of 1) measuring the said nip pressure, 2) determining the diameter of the web roll being wound when the said nip pressure is measured, 3) comparing the said nip pressure with a desired nip pressure for the diameter of the web roll being wound, 4) adjusting the said nip pressure relative to the said desired nip pressure as a function of the diameter of the web roll being wound.

11. A method of reeling a traveling paper web, as set forth in claim 8, wherein:

the transferring of the traveling paper web onto the said another reel spool includes the step of positioning the web roll being wound downstream translationally in a horizontal movement such that the web roll being wound is disengaged from nipping contact with the support drum and an unsupported span is created in the traveling web between the web roll being wound and the support drum;

producing a bubble in the traveling paper web in the span intermediate the said paper web roll being wound and the support drum;

turning up the bubble of the traveling paper web to urge the bubble of the traveling paper web into wrapping engagement with the said another new reel spool to commence reeling a new web roll thereon;

severing the paper web intermediate the web roll being wound on the reel spool and the web roll being wound on the said another new reel spool.

* * * * *